US011280333B2

(12) United States Patent
Suttmann et al.

(10) Patent No.: US 11,280,333 B2
(45) Date of Patent: Mar. 22, 2022

(54) PROGRESSIVE CAVITY PUMP HAVING IMPROVED STATOR DRY-RUNNING PROTECTION

(71) Applicant: CIRCOR PUMPS NORTH AMERICA, LLC., Monroe, NC (US)

(72) Inventors: Bernd Suttmann, Schermbeck (DE); Patrick Wecking, Borken (DE)

(73) Assignee: CIRCOR PUMPS NORTH AMERICA, LLC., Monroe, NC (US)

( * ) Notice: Subject to any disclaimer, the term of this patent is extended or adjusted under 35 U.S.C. 154(b) by 171 days.

(21) Appl. No.: 16/612,934

(22) PCT Filed: May 16, 2017

(86) PCT No.: PCT/US2017/032785
§ 371 (c)(1),
(2) Date: Nov. 12, 2019

(87) PCT Pub. No.: WO2018/212759
PCT Pub. Date: Nov. 22, 2018

(65) Prior Publication Data

US 2020/0166031 A1 May 28, 2020

(51) Int. Cl.
*F01C 1/10* (2006.01)
*F03C 2/00* (2006.01)
(Continued)

(52) U.S. Cl.
CPC ..... *F04C 2/107* (2013.01); *F04C 2/1071* (2013.01); *F04C 2/1075* (2013.01); *F04C 14/28* (2013.01); *F04C 2270/19* (2013.01)

(58) Field of Classification Search
CPC ..... F04C 2/107; F04C 2/1071; F04C 2/1075; F04C 14/28; F04C 2240/81;
(Continued)

(56) References Cited

U.S. PATENT DOCUMENTS 3,081,631 A * 3/1963 Switzer, Jr. ..... G01K 13/02 374/148
4,265,603 A 5/1981 Chiyoda et al.
(Continued)

FOREIGN PATENT DOCUMENTS

DE 2311770 A1 9/1974
DE 3615795 A1 * 11/1987 ..... F04C 2/1075
(Continued)

OTHER PUBLICATIONS

DE-3615795-A1—Jaeger Andreas—Method of Manufacturing Eccentric Screw Pumps Nov. 12, 1987—English machine Translation (Year: 1987).*
(Continued)

*Primary Examiner* — Theresa Trieu
(74) *Attorney, Agent, or Firm* — Kacvinsky Daisak Bluni PLLC

(57) ABSTRACT

A system and method for coupling a temperature monitoring system within a progressive cavity pump to combat dry-running. A temperature monitoring system for use in a progressive cavity pump for monitoring the internal temperature of an elastomeric stator. The temperature monitoring system includes a sleeve and a temperature sensor disposed therein. The sleeve is inserted into a shell portion of the stator before vulcanizing the elastomeric stator so that the sleeve is vulcanized to the elastomeric stator.

15 Claims, 7 Drawing Sheets

(51) Int. Cl.

| | |
|---|---|
| ***F03C 4/00*** | (2006.01) |
| ***F04C 18/00*** | (2006.01) |
| ***F04C 2/107*** | (2006.01) |
| ***F04C 14/28*** | (2006.01) |

(58) Field of Classification Search
CPC ..... F04C 2270/19; F04C 2270/195; F04C 2270/70; F04C 2270/86; F04C 2270/22; F04C 2270/225; F05C 2225/00–12
See application file for complete search history.

(56) References Cited

U.S. PATENT DOCUMENTS 5,168,709 A * 12/1992 Bombard ..... B01D 5/0039 62/48.1
6,207,756 B1 * 3/2001 Datta ..... C08L 23/04 525/191
7,265,193 B2 * 9/2007 Weng ..... C08F 210/06 526/160
7,407,372 B2 8/2008 Guidry et al.
2006/0247332 A1 * 11/2006 Coffey ..... C08K 5/0016 523/351

FOREIGN PATENT DOCUMENTS

DE 102009056119 A1 7/2010
JP 5364105 B2 12/2013

OTHER PUBLICATIONS

International Search report dated Jan. 19, 2018 for PCT/US2017/032785 filed May 16, 2017, 4 pages.
Written Opinion dated Jan. 19, 2018 for PCT/US2017/032785 filed May 16, 2017, 8 pages.
International Preliminary Report on Patentability for the International Patent Application No. PCT/US2017/032785, dated Nov. 28, 2019, 9 pages.

* cited by examiner

PROGRESSIVE CAVITY PUMP HAVING IMPROVED STATOR DRY-RUNNING PROTECTION

This is a national stage application filed under 35 U.S.C. § 371 of pending international application PCT/US2017/032785 filed May 16, 2017, the entirety of which application is hereby incorporated by reference herein.

FIELD OF THE DISCLOSURE

The present disclosure generally relates to a progressive cavity pump having improved stator dry-running protection. More specifically, the present disclosure describes an improved temperature monitoring system for use in a progressive cavity pump.

BACKGROUND OF THE DISCLOSURE

FIG. 1 illustrates a partial, cross-sectional view of a progressive cavity pump, also commonly referred to as an eccentric screw pump (collectively referred to herein as a progressive cavity pump without the intent to limit) 100. Progressive cavity pumps 100 may include a helical rotor 110 (FIG. 2) and a stator 120.

The stator 120 may have a shell portion 125 within which is disposed an elastomeric material having internally molded cavities 127. The rotor 110 may be rotatably located within the stator 120. Generally speaking, the rotor 110 may be manufactured from a metal such as, for example, hardened steel, stainless steel, etc. The internal molded cavities 127 of the stator 120 may be formed by a synthetic or natural rubber such as, vulcanized elastomer. The elastomer may be formed by filling the space between the inner surface 126 of the shell portion 125 of the stator 120 and a jacket or form placed within the stator 120.

In use, the rotor 110 seals tightly against the elastomeric stator 120 as it rotates, forming a set of tightly seal, fixed-size cavities. Rotation of the rotor 110 causes the cavities to move towards a discharge port resulting in movement of any material (e.g., liquid) inside of the cavities.

One problem generally associated with progressive cavity pumps is referred to as dry-running. During a dry-running event, friction between the rotor 110 and stator 120 causes the temperature at the internal surface of the stator 120 to quickly rise. When the operating temperature at the internal surface of the stator 120 exceeds its maximum permissible operating temperature, the elastomer can burn or otherwise degrade, causing a malfunction of the progressive cavity pump. That is, as the heat energy generated in the conveying elements (e.g., rotor 110 and stator 120) of the progressive cavity pump is no longer being adequately dissipated, the elastomeric stator 120 can be thermally damaged within a short period resulting in failure of the progressive cavity pump, and causing unscheduled operating failures, downtimes and costly repairs to, for example, replace the stator 120.

In view of this, progressive cavity pumps often incorporate a dry-running protection device. FIG. 1 shows one form of dry-running protection that is often used. A temperature monitoring system 130 can be employed to monitor the operating temperature in the elastomeric stator 120. The temperature monitoring system 130 may protect against dry-running by monitoring the temperature of the elastomeric stator 120, and when the system detects that the temperature of the elastomeric stator 120 has exceeded a predetermined threshold temperature, the temperature monitoring system 130 may transmit a signal to a control unit 150 to shut-off or otherwise control operation of the progressive cavity pump 100 in a manner that minimizes or eliminates the risk of thermal damage to the stator. The control unit 150 may be a digital, electronic control unit located in a switch cabinet. The control unit 150 may include a microprocessor, memory and one or more user interfaces so that an operator can set the predetermined threshold temperature for switching off the progressive cavity pump 100. In addition, the control unit 150 may include a display for displaying the predetermined threshold temperature. The control unit 150 may be communicatively coupled to the temperature monitoring system 130 via a wire 152. Alternatively, the control unit 150 may be wirelessly coupled to the temperature monitoring system 130. Alternatively, the control unit may be internally located within the connection head of the temperature monitoring system 130.

In use, the control unit 150 is arranged and configured to receive signals from the temperature monitoring system 130 and to determine when the operating temperature of the elastomeric stator portion has exceeded the predetermined threshold temperature. When the control unit 150 determines that the current operating temperature of the elastomeric stator portion is greater than or exceeds the predetermined threshold temperature, the control unit 150 may shut off operation of the progressive cavity pump 100.

Referring to FIGS. 2-3, known temperature monitoring systems 130 may include a sleeve 134 and a temperature sensor 136. The temperature monitoring system 130 may also include a ferrule 138, a locking screw 140 and a connection head 142. The connection head 142 may include electronic connections and devices for communicating with the external control unit 150. Alternatively, the connection head 142 may include an internal control unit (not shown). The locking screw 140 may be used to secure the position of the sleeve 134. The ferrule 138 may be coupled to the connection head 142 before rotatably coupling the connection head 142 in place.

Generally speaking, known temperature monitoring systems 130 may be coupled to progressive cavity pumps 100, by forming a precisely positioned borehole 132 into the finished elastomeric stator 120. The borehole 132 may extend completely through the elastomeric stator 120 into the delivery space of the stator 120 occupied by the rotor 110 or the borehole 132 may cease somewhere within the elastomeric stator 120. The sleeve (e.g., metallic sleeve) 134 may then be inserted into the borehole 132. A temperature sensor 136 may then be inserted into the sleeve 134.

Some of the challenges faced by known temperature monitoring systems 130, which rely on introducing the temperature sensor 136 into the sleeve 134, include:

(1) the borehole 132 must be accurately positioned. For example, the borehole 132 should be located in the area where the largest elastomeric wall thickness to measure the area of highest temperature;

(2) inserting a sleeve 134 that is too long may cause the sleeve 134 to contact the rotor 110 during use, thus resulting in damage to the rotor 110 and/or sleeve 134;

(3) insufficient insertion of the sleeve 134 may lead to poor heat transfer and thus cause a delay in switching-off the pump 100 potentially causing the elastomeric stator 120 to become thermally damaged;

(4) during operation, the sleeve 134 may loosen due to incorrect operation or vibrations, which may cause the sleeve 134, and hence the temperature sensor 136, to contact the rotor 110 or be located too far away thus resulting in poor heat transfer; and (5) the seal between the sleeve 134 and the elastomeric stator 120 may not be reliable potentially resulting in leaks and discharge of the conveying medium.

In view of the foregoing, it would be desirable to provide a new and improved temperature monitoring system for use in a progressive cavity pump to protect against dry-running.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is a progressive cavity pump having improved stator dry-running protection. More specifically, the present disclosure describes an improved monitoring system, for example, an improved temperature monitoring system, for use in a progressive cavity pump.

In one embodiment, the present disclosure is directed to a method for coupling a monitoring system (e.g., temperature monitoring system) to a progressive cavity pump. The method may include forming a borehole in a shell portion of a stator; inserting a sleeve into the borehole; forming an elastomeric portion of the stator such that the sleeve is vulcanized to the elastomeric portion of the stator; and inserting a sensor (e.g., temperature sensor) into the sleeve. Forming the elastomeric portion of the stator may include pouring an elastomer into the shell portion of the stator and vulcanizing the poured elastomer. Alternatively, the sleeve may be omitted and the sensor (e.g., temperature sensor) may be inserted directly into the borehole so that the sensor may be vulcanized directly to the stator.

The borehole and sleeve may include corresponding threads so that inserting the sleeve into the borehole includes threading the sleeve into the borehole. The externally threaded surface may be pre-treated with a binder or primer.

In an alternate embodiment, the present disclosure is directed to a progressive cavity pump. The pump may include a stator including a shell portion and a molded elastomeric portion having internally molded cavities; a helical rotor rotatably located within the stator; and a monitoring system (e.g., temperature monitoring system) for measuring an operating parameter (e.g., operating temperature) of the elastomeric portion of the stator, the monitoring system including a sensor (e.g., temperature sensor); wherein the sensor may be vulcanized (either directly or indirectly) to the elastomeric portion of the stator. The monitoring system may further include a sleeve, the sleeve being vulcanized to the elastomeric portion of the stator, the sensor being slidably received within the sleeve.

The shell portion may include a borehole for receiving the sleeve. The sleeve may be inserted into the shell portion before vulcanizing the elastomeric material for forming the molded elastomeric portion of the stator.

The inner surface of the borehole and the external surface of the sleeve may include corresponding threads so that the sleeve may be threadably coupled to the borehole formed in the shell portion of the stator.

The borehole formed in the shell portion of the stator may be positioned at a predetermined location with respect to the elastomeric portion so that no portion of the sleeve is exposed to pumped media.

The vulcanized connection between the sleeve and the elastomeric portion may result in the sleeve forming an integral part of the stator.

The sensor (e.g., temperature sensor) may be configured to monitor an operating temperature of the elastomeric portion of the stator. The temperature sensor may be communicatively coupled to a control unit. The control unit being configured to receive signals from the temperature monitoring system and to determine when the operating temperature of the elastomeric portion of the stator has exceeded a predetermined threshold temperature. The control unit further being configured to control operation of the progressive cavity pump when the operating temperature of the elastomeric portion of the stator is determined to have exceeded the predetermined threshold temperature.

The temperature sensor or sleeve may include a pointed or spherical shaped tip.

The inner surface of the shell portion and an outer surface of the sleeve may be coated with a chemical binder system for enhancing a connection between the elastomeric portion, the shell portion and the sleeve.

BRIEF DESCRIPTION OF THE DRAWINGS

By way of example, specific embodiments of the disclosed device will now be described, with reference to the accompanying drawings, in which.

DETAILED DESCRIPTION

Figure 1:
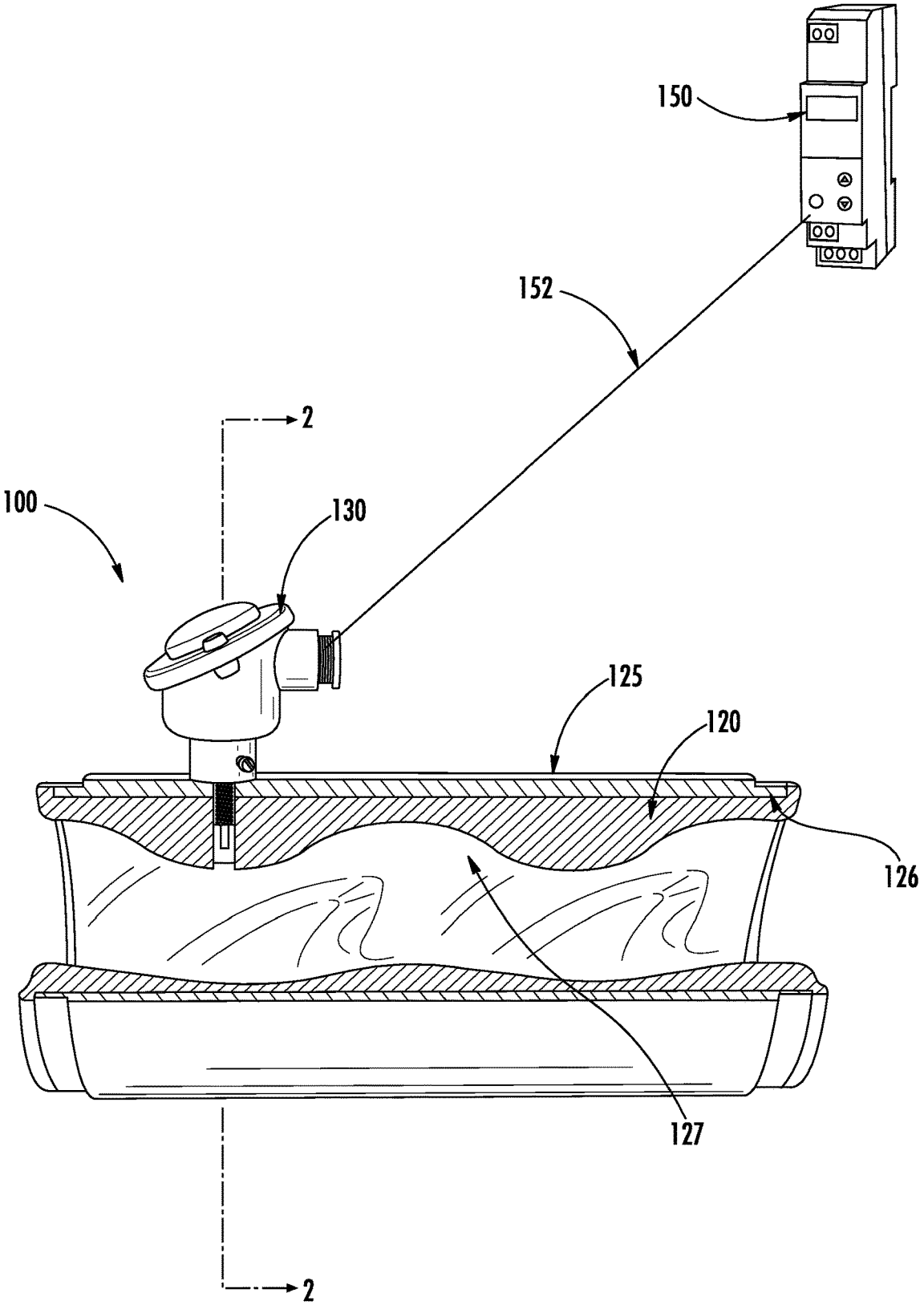
FIG. 1 PRIOR ART
FIG. 1 illustrates a partial, longitudinal cross-sectional view of a known progressive cavity pump.
Figure 2:
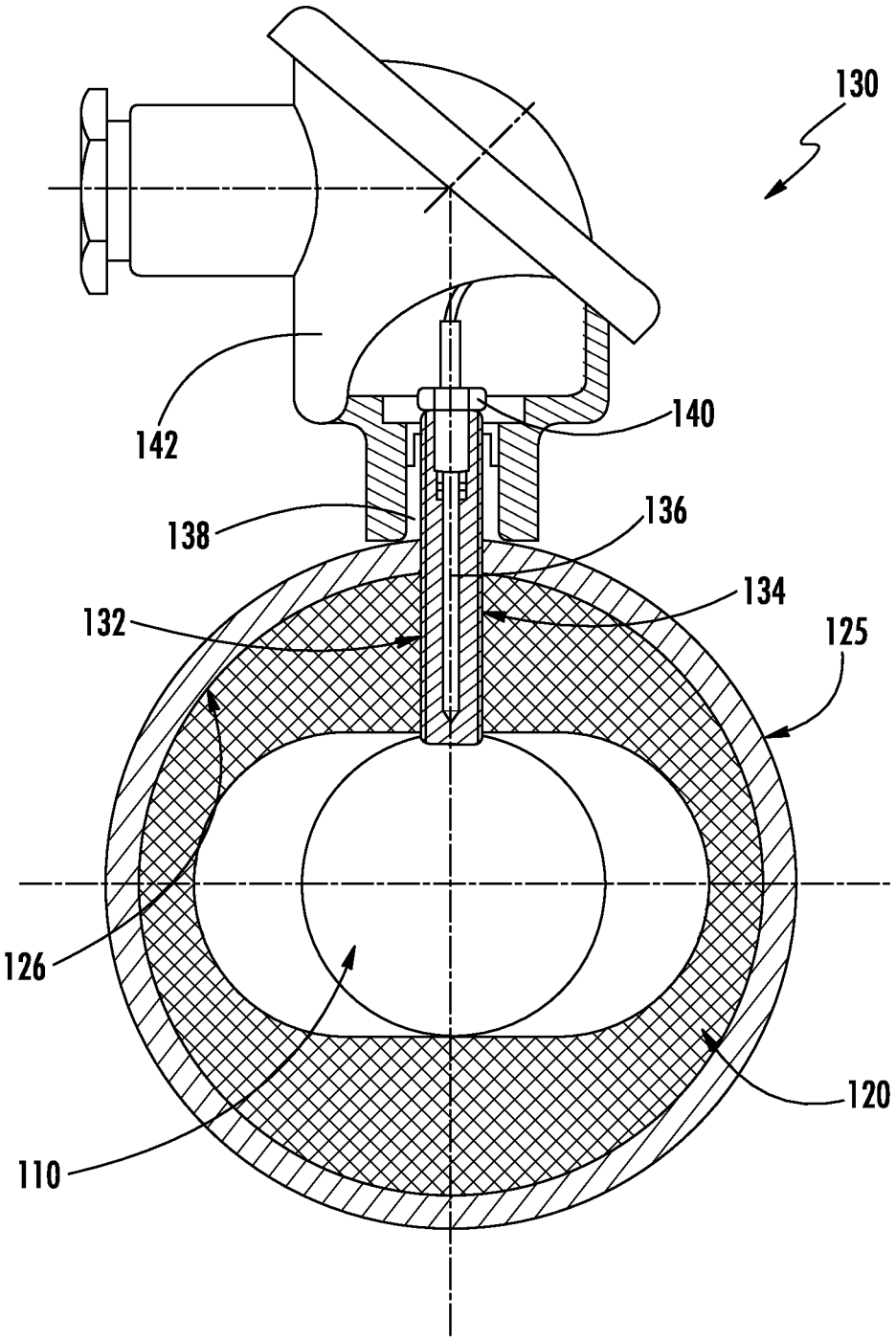
FIG. 2 PRIOR ART
FIG. 2 illustrates a cross-sectional view of the progressive cavity pump taken along line 2-2 in FIG. 1.
Figure 3:
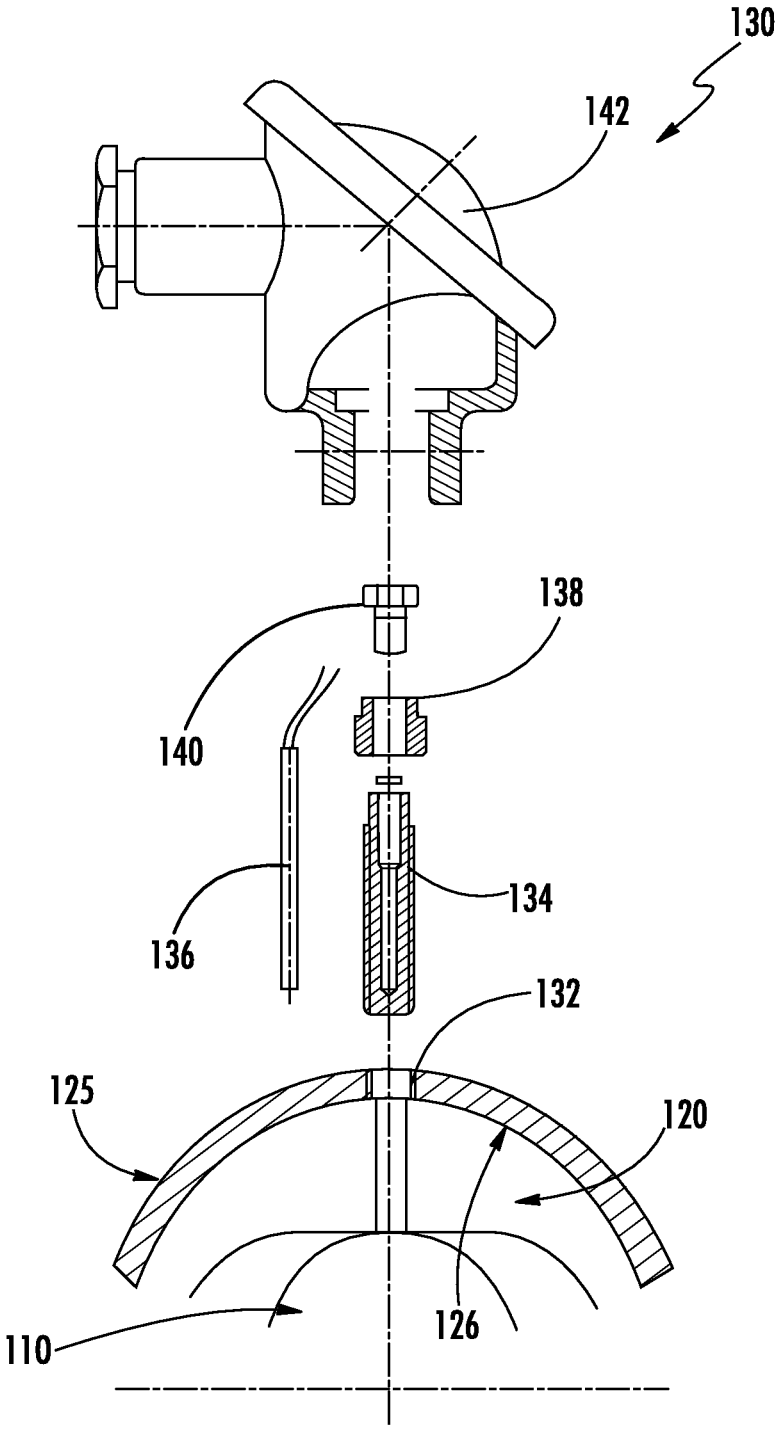
FIG. 3 PRIOR ART
FIG. 3 illustrates an exploded view of a known temperature monitoring system used in combination with the progressive cavity pump shown in FIG. 1.

A device and method in accordance with the present disclosure will now be described more fully hereinafter with reference to the accompanying drawings, in which preferred embodiments of the device and method are shown. The disclosed device and method, however, may be embodied in many different forms and should not be construed as being limited to the embodiments set forth herein. Rather, these embodiments are provided so that this disclosure will be thorough and complete, and will fully convey the scope of the device and method to those skilled in the art. In the drawings, like numbers refer to like elements throughout.

Figure 4:
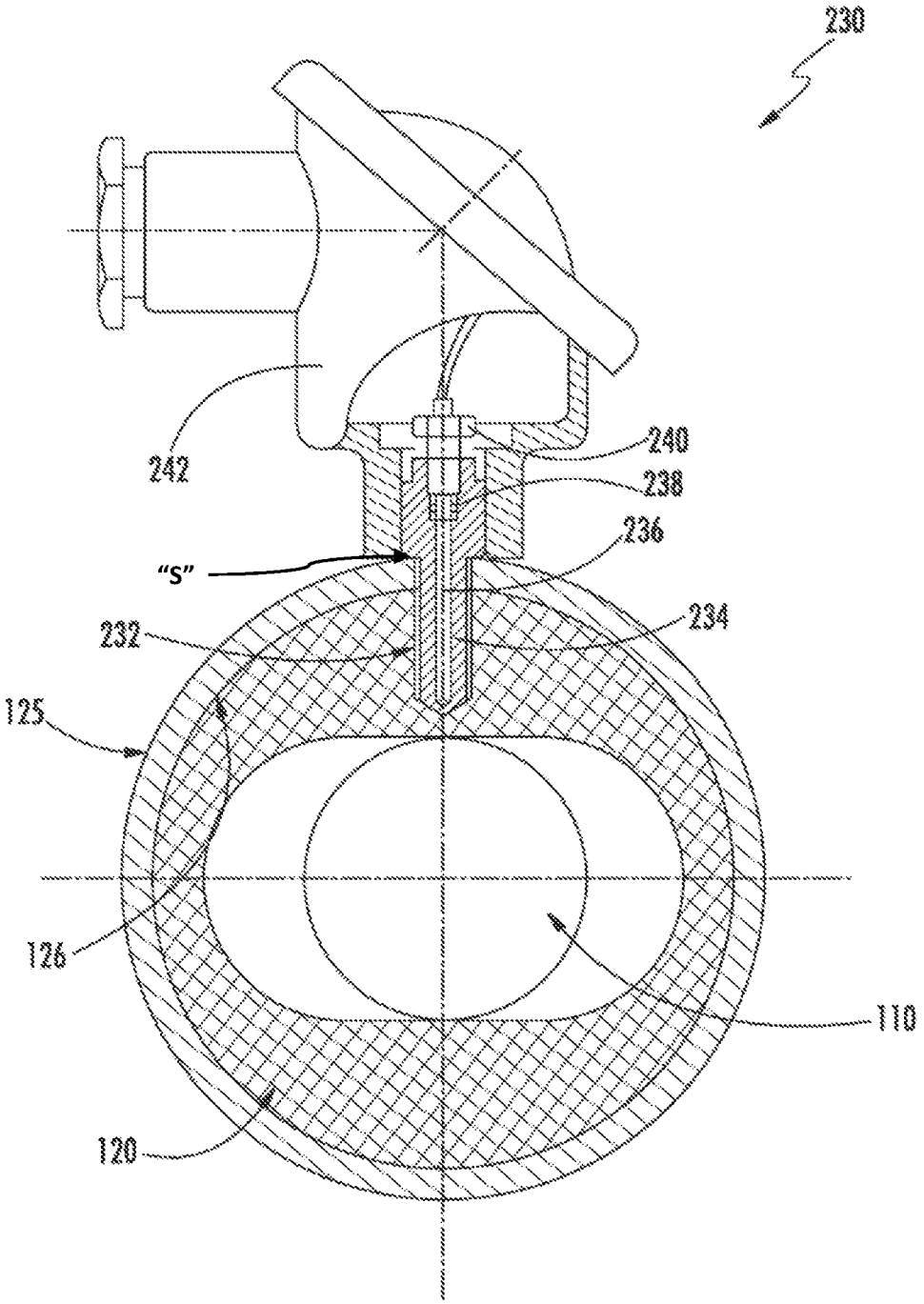
FIG. 4 illustrates an exemplary embodiment of a temperature monitoring system according to the present disclosure that may be used in combination with the progressive cavity pump in FIG. 1.
Figure 5:
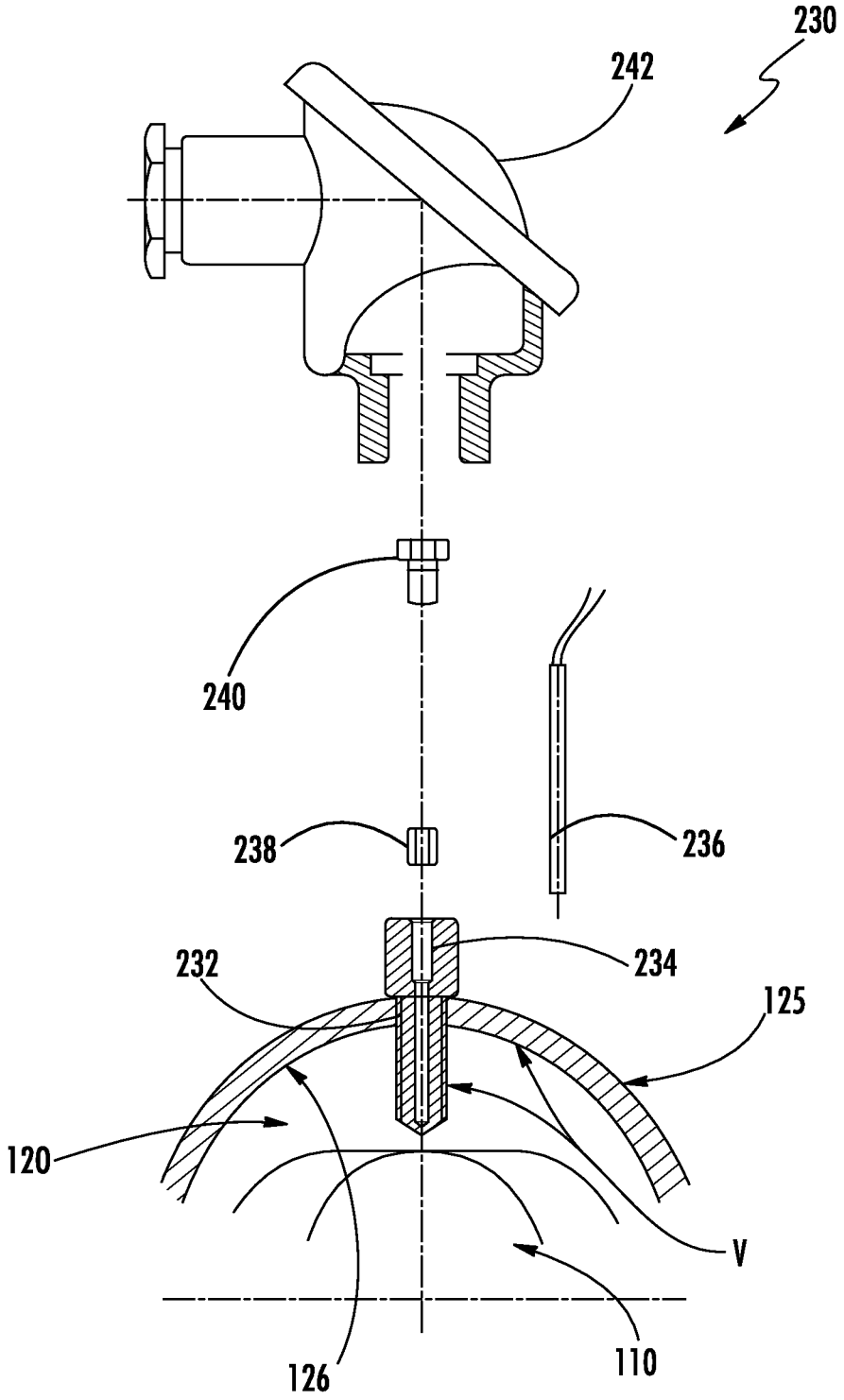
FIG. 5 illustrates an exploded view of the exemplary temperature monitoring system shown in FIG. 4.

The present disclosure describes an improved system and method for coupling a temperature monitoring system within a progressive cavity pump. More specifically, the present disclosure describes a temperature monitoring system and method wherein the sleeve element may be vulcanized to the elastomeric stator. Referring to FIGS. 4-5, an exemplary embodiment of a temperature monitoring system 230 according to the present disclosure is illustrated. As shown, the temperature monitoring system 230 may include a sleeve 234, and a temperature sensor 236 disposed therein. The temperature monitoring system 230 may also include a clamp hose 238, a clamping screw 240, and a connection head 242. The connection head 242 may include electronic connections and devices for communicating with the external control unit 150. Alternatively, the connection head 242 may include an internal control unit (not shown). The clamp hose 238 and clamping screw 240 may be incorporated to assist with properly positioning of the temperature sensor 236 within the sleeve 234. The temperature sensor 236 may be any temperature sensor now known or hereafter developed such as, for example, a Pt100 sensor, a thermocouple, a bimetal switch, etc.

Alternatively, the connection head 242, the sleeve 234 and the temperature sensor 236 can be replaced with a temperature switch (not shown), which can monitor the temperature in the stator, and may control operation of the pump 100 when it determines that the temperature of the stator 120 exceeds a predetermined threshold. Such an arrangement can be entirely mechanical, and may eliminate associated electronic components. In use, as will be described in greater detail, the temperature switch can be positioned inside of the sleeve 234 (e.g., similar to the temperature sensor). Alternatively, as will be described in greater detail below with regards to the temperature sensor, the temperature switch may be directly embedded into (and vulcanized to) the elastomeric stator (e.g., without an intervening sleeve). The choice on whether to use a sleeve or not may depend on the size of the temperature switch.

In addition, although the present disclosure illustrates and discusses use of the temperature monitoring system for use in a progressive cavity pump, it is contemplated that the improved temperature monitoring system may be used in connection with other pumps and any other appropriate applications.

The present disclosure achieves the desired results by inserting the sleeve 234 into the shell portion 125 of the stator 120 before vulcanizing the elastomeric stator. Generally speaking, the stator can be formed by incorporating a stator jacket within the shell portion 125 of the stator 120 and then filling the space between the stator jacket and the inner surface 126 of the shell portion 125 of the stator 120 with elastomeric material. The elastomeric material may then be vulcanized.

The shell portion 125 of the stator 120 may have any shape appropriate for such purposes. For example, the shell portion 125 of the stator 120 may be in the form of a tube. Alternatively, the shell portion 125 of the stator 120 may have, for example, a shape substantially matching the inner contour of the stator so that the shell portion may have a uniform wall thickness.

By inserting the sleeve 234 into the shell portion 125 of the stator 120 prior to forming and/or vulcanizing the elastomeric stator 120, a number of advantages are achieved. For example, the sleeve 234 may now be an integral part of the stator 120. That is, with the sleeve 234 positioned in the shell portion 125 of the stator 120, when the elastomer is vulcanized, the sleeve 234 may be enclosed and bonded by the vulcanized elastomer, and preferably completely enclosed by the vulcanized elastomer. As a result, the sleeve 234 becomes a fixed and unchanging part of the stator 120. As such, subsequent unscrewing of the sleeve 234 is no longer possible. Thus, subsequent undesirable movement of the sleeve 234 due to vibrations or incorrect operation is minimized or eliminated. The elastomeric stator 120 may be made from any appropriate elastomer including, for example, Butyl, EPDM, Perbunan, hydrogenated Perbunan, Alldur, Neoprene, Polyurthan, Silicon, Viton, Butadien, Hypalon, etc.

In addition, the disclosed arrangement and technique allows the sleeve 234 to be precisely and correctly located. Because the borehole 232 may be formed in the shell portion 125 of the stator at the manufacturing facility during initial construction of the progressive cavity pump 100, the location of the sleeve 234 may be precisely and accurately controlled. In addition, the insertion depth of the sleeve 234, which is optimally determined by the design of the progressive cavity pump 100, may also be precisely determined and located. As a result, the risk that the sleeve 234 will extend completely through the elastomeric stator 120 and into contact with the rotor 110 or medium, as can occur with prior arrangements, is minimized or completely eliminated.

Moreover, by vulcanizing the sleeve 234 within the elastomeric material of the stator 120, a tight elastomer-metal connection between the elastomeric stator 120 and the sleeve 234 can be provided, which, as will be appreciated, can maximize heat transfer between the elastomer and the sleeve (and hence the temperature sensor 236). In addition, because the sleeve 234 will no longer be exposed directly to the pumped media, the sleeve 234 needn't be manufactured from a corrosion resistant material (e.g., stainless steel). For example, the sleeve 234 may be manufactured from a structural steel (e.g., S185, 5235, 5275, 5355, E295, E235, E360, etc.), a quenching or tempering steel (e.g., C22, C45, C60, 42CrMo4, etc.), a stainless steel (e.g., 1.4301, 1.4571, 1.4404, SS316, etc.), etc.

In addition, the disclosed arrangement can minimize or eliminate leakage problems between the sleeve 234 and stator 120 because gaps between the sleeve 234 and the elastomer are minimized or eliminated. Moreover, the disclosed arrangement eliminates the need to drill the borehole through the elastomeric stator 120, thus the interior contour of the stator 120 is not interrupted, which minimizes or eliminates any danger of the elastomer being damaged. Dynamic resilience of the elastomer is maintained throughout, even in the area between the end of the temperature sensor 236 and the inner contour of the stator 120.

Figure 6:
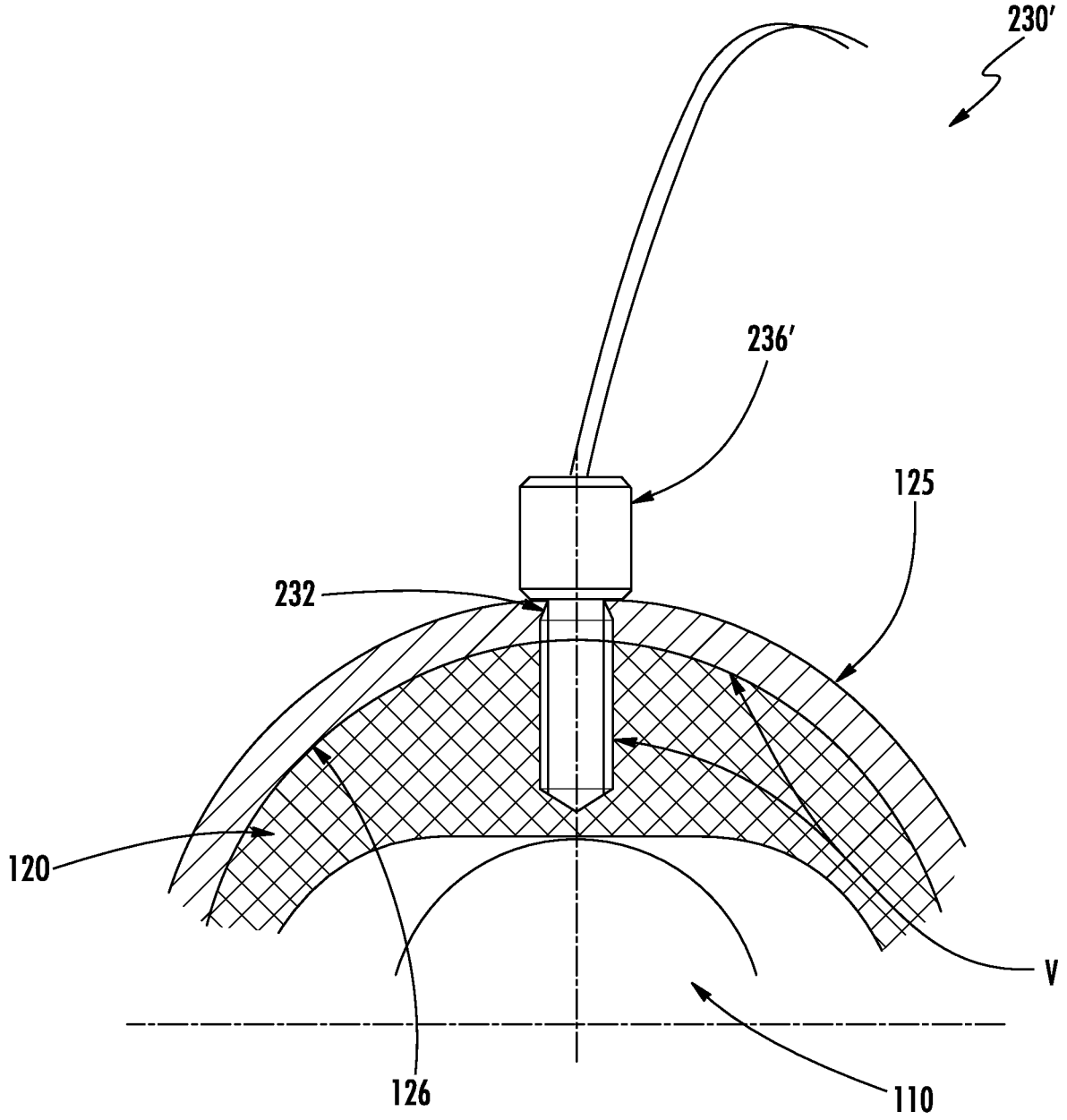
FIG. 6 illustrates an alternate exemplary temperature monitoring system according to the present disclosure that may be used in combination with the progressive cavity pump in FIG. 1.

Referring to FIG. 6, in an alternate embodiment, the temperature monitoring system 230' may include a temperature sensor 236 that is adapted and configured to be inserted into the borehole 232 and thus into the stator 120 directly, without an intervening sleeve. In this manner, the temperature sensor 236' can be vulcanized V directly into the elastomeric stator without the intervening sleeve.

Figure 7:
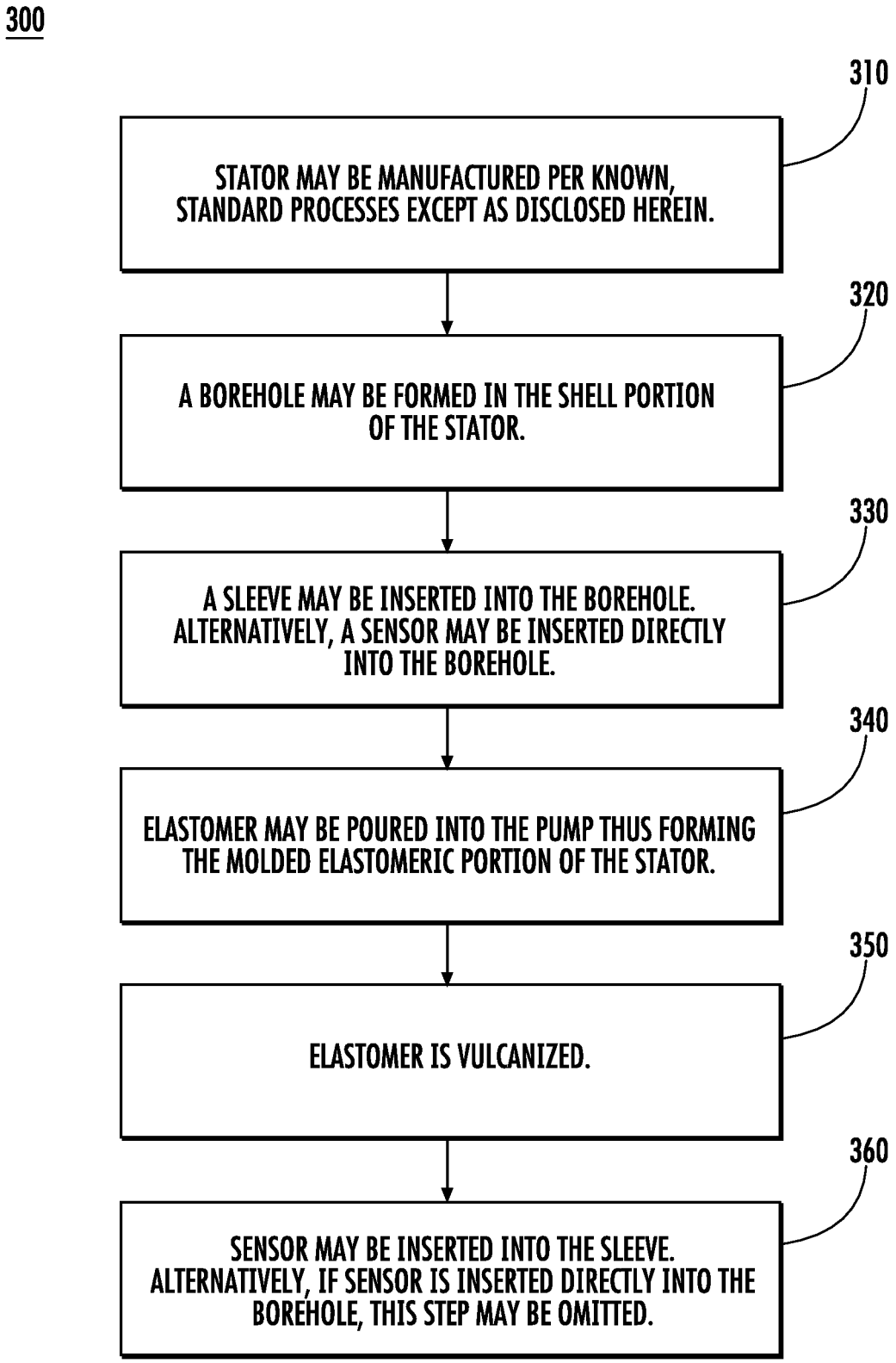
FIG. 7 illustrates a block diagram of an exemplary method for incorporating a temperature monitoring system into a progressive cavity pump according to the present disclosure.

Referring to FIG. 7, according to one aspect of the present disclosure, an improved method 300 for coupling a temperature monitoring system to a progressive cavity pump is disclosed.

At 310, the stator may be manufactured per known, standard processes except as disclosed herein. At 320, a borehole may be formed in the shell portion of the stator. The borehole may be threaded, which in one non-limiting exemplary embodiment is an M10 screw thread. Using standard manufacturing processes, the stator may be rotated so that the threaded borehole (e.g., M10 screw thread) may be easily and consistently positioned in the same position with respect to the mold. Thus, the sleeve may be consistently positioned in the region where the wall thickness of the elastomer is the greatest, after elastomer filling.

At 330, a sleeve may be inserted into the borehole. The sleeve may include a corresponding outer thread (e.g., M10)

for threadably engaging the threads of the borehole. In one embodiment, the sleeve may be inserted (e.g., threaded) into the shell portion of the stator until a protruding shoulder "S" (FIG. 4) of the sleeve presses firmly against an outer surface of the shell portion. By positioning the protruding shoulder "S" a predetermined distance from the tip of the sleeve, this may automatically ensure a consistent and accurate sleeve depth within the stator. In one embodiment, the external threads and the outer surface of the sleeve may be pretreated with a binder or primer to enhance the connection between the sleeve and the elastomer upon vulcanization. The binder or primer may be any primer or binder appropriate for the application. For example, a 2-layer system consisting of binder and primer, a 1-layer system with a binder, a 1-layer adhesion promoter, etc. In use, the binder or primer may be coated by spraying. In one embodiment, the metal surfaces of the shell portion of the stator and/or the sleeve should be degreased and sand blasted with a blasting agent. The layer of the binder or primer may include a defined thickness (e.g., min. and max.) to have a maximum bond.

Alternatively, if the temperature sensor is being inserted directly into the stator without an intervening sleeve as described above in connection with FIG. 6, the temperature sensor may be inserted into the borehole.

At 340, elastomer may be poured into the pump thus forming the molded elastomeric portion of the stator. For example, unvulcanized elastomer may be poured into the shell portion of the stator in-between the jacket of the stator and the inner surface of the shell portion. During this process, the sleeve (or the temperature sensor if no intervening sleeve is used) may be enclosed by the elastomer, and preferably completely enclosed by the elastomer. At this point, the sleeve (or the temperature sensor if no intervening sleeve is used), along with the inner surface of the shell portion, are not yet vulcanized to the elastomeric stator.

Alternatively, it is envisioned that a plug screw may be used in the place of an externally threaded sleeve. In this embodiment, a suitable device such as, for example, a press, extruder, etc. can be used to press the unvulcanized elastomer. Thereafter, after the pouring of elastomer, the plug screw may be removed and replaced by a corresponding sleeve. This prevents the elastomer from mechanically deforming the sleeve during the filling process.

At 350, the unvulcanized elastomer may be vulcanized. Generally speaking, vulcanization of an elastomer is a well-known chemical process for converting natural rubber or related polymers into more durable materials via the addition of sulfur or other equivalent curatives or accelerators. These additives modify the polymer by forming cross-links (bridges) between individual polymer chains. Vulcanization can be accomplished by any process now known or hereafter developed, including for example, via an oil bath vulcanization, a hot air vulcanization process, or via an automatic machine for stator manufacturing.

At 360, the temperature sensor may be inserted into the sleeve. Further assembly of the individual components of the temperature monitoring system may be carried out according to existing operating instructions. This step may be omitted if the temperature sensor is inserted directly into the borehole (e.g., where no intervening sleeve is used).

In one embodiment, depending on the diameter of the stator, a corresponding sleeve size may be selected. In addition, as the sleeves are preferably sized so as not to contact the medium, the sleeve can be made from carbon steel or other non-corrosion resistant material.

In an alternate embodiment, while the present disclosure has been illustrated and described as vulcanizing, either directly or indirectly (e.g., via a sleeve), a temperature sensor, the present disclosure should not be so limited. Rather, the present system and method may work to vulcanize, either directly or indirectly, other types of sensors as well including, for example, a pressure sensor, a vibration sensor, etc.

In one embodiment, the inner surface of the shell portion may be provided with or coated with a chemical binder system prior to filling with elastomer. As a result, an insoluble rubber-metal compound may be produced during the vulcanization process. Similarly, the sleeve may be provided or coated with a chemical binder system. As a result, an insoluble rubber-metal compound may be produced during the vulcanization process.

In one embodiment, the vulcanization process preferably takes place under pressure and temperature (e.g., oil bath, heating furnace, autoclave, etc.). In this case, due to the pretreatment, an inseparable connection is established between the vulcanized elastomer of the stator and the inner surface of the shell portion of the stator as well as with the outer surface (e.g., threaded surface) of the sleeve. Thus, the sleeve may now be completely vulcanized within the elastomer.

In one embodiment, the temperature sensor or sleeve may have a pointed or spherical shape. By providing a pointed or spherical shaped end, the wall thickness of the elastomer does not remain constant but rather may increasing towards the sides. This ensures that the elastomer has a sufficient flexibility in this region.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A progressive cavity pump comprising:

a stator including a shell portion and a molded elastomeric portion having an internally molded cavity comprising a delivery space;

a helical rotor rotatably located within the delivery space; and a monitoring system for measuring an operating parameter of the elastomeric portion of the stator, the monitoring system including a sensor;

wherein the monitoring system further comprises a sleeve, the sleeve vulcanized to the elastomeric portion of the stator, the sensor slidably received within the sleeve;

wherein the shell portion includes a borehole for receiving the sleeve; and wherein the borehole formed in the shell portion of the stator is positioned at a predetermined location with respect to the elastomeric portion so that the elastomeric portion completely encloses the sleeve such that no portion of the sleeve is exposed to the delivery space and pumped media therein.

2. The progressive cavity pump of claim 1, wherein an inner surface of the borehole is threaded and an external surface of the sleeve is threaded so that the sleeve is threadably coupled to the borehole formed in the shell portion of the stator.

3. The progressive cavity pump of claim 1, wherein a vulcanized connection between the sleeve and the elastomeric portion results in the sleeve forming an integral part of the stator.

4. The progressive cavity pump according to claim 1, wherein the monitoring system is a temperature monitoring system, the operating parameter is an operating temperature of the stator, and the sensor is a temperature sensor configured to monitor the operating temperature of the elastomeric portion of the stator.

5. The progressive cavity pump of claim 4, wherein the temperature monitoring system is communicatively coupled to a control unit, the control unit being configured to receive signals from the temperature monitoring system and to determine when the operating temperature of the elastomeric portion of the stator has exceeded a predetermined threshold temperature, the control unit further configured to control operation of the progressive cavity pump when the operating temperature of the elastomeric stator is determined to have exceeded the predetermined threshold temperature.

6. The progressive cavity pump of claim 4, wherein the temperature sensor or sleeve includes a pointed or spherical shaped tip.

7. The progressive cavity pump of claim 4, wherein the temperature sensor is a temperature switch.

8. The progressive cavity pump of claim 1, wherein an inner surface of the shell portion and an outer surface of the sleeve is coated with a chemical binder system for enhancing a connection between the elastomeric portion, the shell portion and the sleeve.

9. A method for coupling a temperature monitoring system to a progressive cavity pump, the method comprising the steps of:

forming a borehole in a shell portion of a stator;

inserting a sleeve into the borehole;

forming an elastomeric portion of the stator within the shell portion, the elastomeric portion including an internal delivery space for receiving a rotor, the elastomeric portion completely enclosing the sleeve such that no portion of the sleeve is exposed to the delivery space and pumped media therein;

vulcanizing the elastomeric portion of the stator within the shell portion of the stator to thereby vulcanize the sleeve to the elastomeric portion; and inserting a temperature sensor into the sleeve.

10. The method of claim 9, wherein the borehole is threaded and the sleeve includes an externally threaded surface so that inserting the sleeve into the borehole includes threading the sleeve into the borehole, and wherein the externally threaded surface is pre-treated with a binder or primer.

11. The method of claim 9, wherein the sleeve is inserted into the borehole until a shoulder formed on the sleeve presses against an outer surface of the shell portion.

12. The method of claim 9, wherein forming the elastomeric portion of the stator includes pouring an elastomer into the shell portion of the stator.

13. A progressive cavity pump comprising:

a stator including a shell portion and a molded elastomeric portion;

a rotor positioned within an internal delivery space of the molded elastomeric portion of the stator;

a monitoring system for measuring an operating parameter of the elastomeric portion of the stator, the monitoring system including a sleeve vulcanized to the elastomeric portion, and a sensor being slidably received within the sleeve;

wherein the shell portion includes a borehole for receiving the sleeve; and wherein the borehole is positioned at a predetermined location with respect to the elastomeric portion so that the elastomeric portion completely encloses the sleeve such that no portion of the sleeve is exposed to the delivery space and pumped media therein.

14. The progressive cavity pump according to claim 13, wherein the monitoring system is a temperature monitoring system, the operating parameter is an operating temperature of the stator, and the sensor is a temperature sensor configured to monitor the operating temperature of the elastomeric portion of the stator.

15. The progressive cavity pump of claim 14, wherein the temperature monitoring system is communicatively coupled to a control unit, the control unit being configured to receive signals from the temperature monitoring system and to determine when the operating temperature of the elastomeric portion of the stator has exceeded a predetermined threshold temperature, the control unit further configured to control operation of the progressive cavity pump when the operating temperature of the elastomeric portion of the stator is determined to have exceeded the predetermined threshold temperature.

* * * * *